US012163426B2

(12) United States Patent
Grotendorst

(10) Patent No.: US 12,163,426 B2
(45) Date of Patent: Dec. 10, 2024

(54) METHOD AND DEVICE FOR LASER DRILLING

(71) Applicant: Arno Romanowski, Toenisvorst (DE)

(72) Inventor: Josef Grotendorst, Dorsten (DE)

(73) Assignee: Arno Romanowski, Toenisvorst (DE)

( * ) Notice: Subject to any disclaimer, the term of this patent is extended or adjusted under 35 U.S.C. 154(b) by 0 days.

(21) Appl. No.: 18/013,601

(22) PCT Filed: Jul. 2, 2021

(86) PCT No.: PCT/EP2021/068291

§ 371 (c)(1),
(2) Date: Dec. 29, 2022

(87) PCT Pub. No.: WO2022/003147

PCT Pub. Date: Jan. 6, 2022

(65) Prior Publication Data

US 2023/0287742 A1 Sep. 14, 2023

(30) Foreign Application Priority Data

Jul. 3, 2020 (DE) ..... 10 2020 117 655.4

(51) Int. Cl.

| | |
|---|---|
| ***E21B 7/15*** | (2006.01) |
| ***E21B 21/12*** | (2006.01) |
| ***E21B 21/16*** | (2006.01) |
| *E21B 17/00* | (2006.01) |
| *E21B 17/02* | (2006.01) |
| *E21B 36/00* | (2006.01) |

(52) U.S. Cl.
CPC ..... *E21B 7/15* (2013.01); *E21B 21/12* (2013.01); *E21B 21/16* (2013.01); *E21B 17/003* (2013.01); *E21B 17/028* (2013.01); *E21B 36/003* (2013.01)

(58) Field of Classification Search
CPC ..... E21B 7/15; E21B 7/14
See application file for complete search history.

(56) References Cited

U.S. PATENT DOCUMENTS

2010/0044102 A1 2/2010 Rinzler et al.

OTHER PUBLICATIONS

International Search Report in PCT/EP2021/068291 dated Nov. 9, 2021 with English translation.

*Primary Examiner* — Kristyn A Hall
(74) *Attorney, Agent, or Firm* — Collard & Roe, P.C.

(57) ABSTRACT

There is a method for drilling a borehole in a rock formation by bombarding the borehole bottom with a laser beam, which is generated by a laser-beam generator situated outside the borehole and is guided by means of suitable auxiliary devices to a laser-drilling head situated at the borehole bottom. The drilling head is coupled with a drill rod, wherein nitrogen, supplied to the laser-drilling head via the drill rod, is split into a partial stream serving as protective gas, which protects the transmitted laser beam from interfering suspended particles. There is a further partial stream, serving as a conveying-gas stream, which transports the rock material detached from the borehole bottom out of the borehole via an annular space remaining between drill rod and borehole wall. The laser beam is guided to a laser drilling head by extending through a laser guide tube.

12 Claims, 2 Drawing Sheets

METHOD AND DEVICE FOR LASER DRILLING

CROSS REFERENCE TO RELATED APPLICATIONS

This application is the National Stage of PCT/EP2021/068291 filed on Jul. 2, 2021, which claims priority under 35 U.S.C. § 119 of German Application No. 10 2020 117 655.4, filed on Jul. 3, 2020, the disclosure of which is incorporated by reference. The international application under PCT article 21(2) was not published in English.

The invention relates to a method and an apparatus for drilling a borehole in a rock formation by bombarding the borehole bottom with a laser beam, which is generated by a laser-beam generator situated outside the borehole and is guided by means of suitable auxiliary devices to a laser-drilling head situated at the borehole bottom and coupled with a drill rod, wherein nitrogen, supplied to the laser-drilling head via the drill rod, is split in the region of the laser-drilling head into

- a partial stream serving as a protective gas stream, which protects the transmitted laser beam from interfering suspended particles,
- and a further partial stream serving as a conveying-gas stream, which transports the rock material detached at the borehole bottom out of the borehole via an annular space remaining between drill rod and borehole wall.

Such an apparatus is known, for example, from US 2010/0044102 A1. In known drilling methods of the said type, a flexible tube is used as the auxiliary device for the guidance of the laser beam and for supplying the nitrogen needed as protective gas and conveying gas, for example a spiral tube, in the inside space of which a glass-fiber cable for the transmission of the laser beam is disposed, while at the same time still leaving sufficient open space in the tube for the passage of an adequate quantity of nitrogen. The protective-gas stream and the laser beam emerge together through an opening turned toward the borehole bottom at the underside of the laser-drilling head and arrive together at the borehole bottom. The energy of the laser beam arriving at the borehole bottom detaches the rock material present there and does so specifically—depending on rock material—by melting, evaporation and/or by spalling. The thermally detached rock material is then forced by the protective-gas stream arriving simultaneously at the borehole bottom in the direction of the periphery of the borehole bottom and is picked up there by the suction of the conveying-gas stream, which is directed in a manner aligned in outward transport direction and which transports the material detached from the borehole bottom out of the borehole via the annular space present between drill rod and borehole wall.

In such methods and apparatuses, a series of mutually conflicting requirements exists that lead to problems in practical execution:

For the thermal detachment, employed in this method, of the rock from the borehole bottom, obviously much energy is needed, which is input substantially by the laser beam. Corresponding tests have shown that a power density of more than 400 W/cm.sup.2 is needed in normal rock formations for the thermal detachment of rock material at the borehole bottom with the use of a laser beam. In order to achieve this power density, the laser beam in apparatuses according to the prior art must be guided in the region of arrival at the borehole bottom in appropriately focused and successive manner over the borehole bottom, for which complicated mechanisms integrated into the laser-drilling head and/or supporting drilling tools are necessary if an adequate drilling advancement is to be achieved. In contrast, it would be better if the entire borehole bottom could be intensively bombarded adequately at the same time, for example by means of an expander lens in the laser-drilling head, although a laser beam with a power of more than 500 kW, preferably 600 KW to 700 KW, would be needed for normal borehole diameters.

However, a laser beam with such a high power can no longer be transmitted simply via a glass-fiber cable, especially when this has to be 2,000 m to 10,000 m long because of the desired borehole depth. This is because glass-fiber cables have a relatively high attenuation, so that the injected laser beam no longer arrives with adequate intensity at the laser-drilling head in the case of such a length of the glass-fiber cable.

In addition, the necessary increase of the power of the laser beam leads to thermal problems, because the energy input with the laser beam and released in the form of heat at the borehole bottom would lead to an impermissible overheating of the laser-drilling head and of the drill rod. In view of such a high power of the laser beam, the supplied quantities of gaseous nitrogen for the protective-gas stream and the conveying-gas stream are not sufficient to remove the excess heat to an adequate extent. In addition, it turns out that an intensive stressing of the borehole bottom by a cold protective-gas stream would lead to a thermal short circuit in the region of the borehole bottom, which would interfere with the process of thermal detachment of the rock material from the borehole bottom.

SUMMARY

It is therefore the task of the invention to further develop the method of the type cited in the introduction to the effect that an adequately rapid drilling advancement is made possible even in very deep boreholes, without the occurrence of harmful overheating at the laser-drilling head or the drill rod.

For accomplishment of this task, the invention provides, starting from the method of the type cited in the introduction,

- that the laser beam is guided to the laser-drilling head via, extending over the length of the drill rod, a laser-guide tube, through the open cross section of which the protective-gas stream is flowing,
- that the nitrogen is supplied to the laser-drilling head via the drill rod in liquid state of matter and in the region of the laser-drilling head is changed into the gaseous state of matter,
- and that a further partial stream serving as heating-gas stream is additionally branched off from the supplied nitrogen, and is heated by means of an electrical heating device associated with the laser-drilling head and is directed toward the borehole bottom being bombarded by the laser beam.

Due to the use, provided according to the invention, of a laser-guide tube through which the protective-gas stream flows instead of the glass-fiber cable that is conventional according to the prior art, it is possible in simple manner to propagate a laser beam having extremely high power almost losslessly over the entire length of the drill rod. This is because clean, gaseous nitrogen has an extremely low attenuating effect. For deflection and any necessary correction of the beam direction of the laser beam within the extent of the laser-guide tube, it is possible in simple manner to dispose, at appropriate spacings within the guide tube, appropriate lens and/or mirror systems, which naturally must not be permitted to interrupt the protective-gas stream that is passing.

By the fact that, additionally in the method according to the invention, the nitrogen is supplied to the laser-drilling head in liquid state of matter and only in the region of the laser-drilling head is changed into the gaseous state of matter, coolant in adequate quantity is available for the cooling of the laser-drilling head, of the protective-gas stream, of the conveying-gas stream and of the drill rod. In particular, the change of the state of matter is extremely endothermic and enlarges the supplied volume considerably, so that cold nitrogen gas is made available in adequate quantity and can be distributed as needed in the region of the laser-drilling head in order to avoid overheating phenomena.

Due to the electrically preheated heating-gas stream that ultimately is also provided according to the invention and directed toward the borehole bottom, the thermal short circuit mentioned above is ultimately prevented. Consequently, it is possible in simple manner to intensify this heating-gas stream arbitrarily to support the work of detachment of the laser beam and at the same time the outward transport of the rock material detached at the borehole bottom in the direction of the conveying-gas stream. Preferably, this heating-gas stream is even given a temperature close to the melting temperature of the respectively adjacent rock.

A further problem in methods according to the invention is that the molten or evaporated rock material contained in the ascending conveying-gas stream must still be cooled to the extent possible to below the solidification temperature of the rock before entry into the annular space between drill rod and borehole wall, so that this rock material does not precipitate on the drill rod and/or on the borehole wall. For this purpose, it is further provided that liquid nitrogen is additionally used as conveying gas, wherein it is injected in the region of the laser-drilling head into the conveying-gas stream flowing back from the borehole bottom and loaded with rock material detached from the borehole bottom, and is changed therein into the gaseous state of matter, with cooling of the conveying-gas stream and the rock material contained in it. The liquid nitrogen used for this purpose is branched off within the laser-drilling head from the liquid nitrogen stream supplied to the laser-drilling head via the drill rod.

Expediently, it is further provided that a further partial stream, which serves as cooling-gas stream and which is passed via the drill rod out of the borehole and in the process cools the drill rod from inside, is branched off from the nitrogen being supplied to the laser-drilling head. Hereby it is additionally ensured that heat from the conveying-gas stream is not supplied unnecessarily to the inside space of the drill rod.

Finally, it is also provided in the method according to the invention that a further partial stream, which keeps clean the laser-beam outlet aperture, turned toward the borehole bottom, of the laser-drilling head and covered with an expander lens, is branched off from the nitrogen supplied to the laser-drilling head to serve as a cleaning-gas stream. Hereby the laser-beam outlet aperture covered in light-transmitting relationship is prevented from becoming soiled by the suspended particles of detached rock material ascending through the borehole and thus being made less transparent for the laser beam.

Subject matter of the invention is further an apparatus for performance of the method discussed above. This apparatus is characterized first of all by a special configuration of the drill rod. This drill rod has:

A laser-guide tube, through which the protective-gas stream flows, for the transmission of the laser beam,

- concentrically surrounding the laser-guide tube with radial clearance, a double tube, through the annular space of which liquid nitrogen flows,
- an insulating tube, concentrically surrounding the double tube with radial clearance,
- and an outer protective tube concentrically surrounding the insulating tube with radial clearance, wherein the annular spaces surrounding the double tube are evacuated,
- the annular space between the outer protective tube and the insulating tube is connected to the cooling-gas stream returning from the laser-drilling head,
- and one or more of the tubes surrounded by the outer protective tube is or are equipped with electrical conductors for transmission of electrical energy and electrical signals to the laser-drilling head.

Such a drill rod permits, with compact construction, the most extensively unattenuated transmission of a high-power laser beam through the laser-guide tube, a passage of liquid nitrogen through the annular space of the double tube in a manner thermally insulated as well as possible by vacuum, a good thermal insulation of the entire drill rod against heat from the conveying-gas stream, and the transmission of electrical energy and electrical signals to the laser-drilling head.

Expediently, it is further provided that the outer protective tube consists of steel and the tubes disposed in the interior of the protective tube consist of carbon-fiber-reinforced plastic (CFP). The outer protective tube consisting of steel gives the entire drill rod the necessary stability and insensitivity to inadvertently occurring overheating from the outside. The material used for the inner tubes is characterized by extremely light weight and extremely high strength and beyond that provides good thermal insulation and extensive electrical insulation.

Furthermore, the apparatus for performance of the method according to the invention is characterized in that the laser-drilling head has a housing, the housing top of which is fastened to the outer protective tube of the drill rod, wherein the housing is further equipped with:

- for the laser beam, extending through the housing and connected to the laser-guide tube of the drill rod, a transmission duct that passes through the housing and the outlet aperture of which is covered in light-transmitting relationship in the region of the housing bottom by an expander lens,
- disposed in the inside space of the housing and connected to the annular space of the double tube of the drill rod, devices for propagation and/or evaporation of the arriving liquid nitrogen as well as for the storage and splitting of gaseous nitrogen to the various provided partial streams,
- disposed in the housing jacket and extending in inclined manner in the direction of flow of the conveying-gas stream, conveying-gas nozzles for the injection of liquid nitrogen into the conveying-gas stream,
- disposed in the housing bottom and directed in the direction of the borehole bottom, heating-gas nozzles for the heating-gas stream,
- disposed in the housing inside space, an electrical heating device for the heating-gas stream, as well as with solenoid valves and volume-flow regulators for the control and regulation of all nitrogen partial streams.

With such a laser-drilling head, it is possible to supply the laser beam arriving via the laser-guide tube of the drill rod in as extensively unattenuated manner as possible to the borehole bottom as well as to evaporate the liquid nitrogen supplied via the double tube of the drill rod and to split it under volume-flow regulation into the various partial flows.

It is further expedient when the partial stream serving as cooling-gas stream passes through the housing inner space and the housing inner space is in communication with the annular space between the outer protective tube and the insulating tube of the drill rod. Hereby the cooling-gas stream responsible for cooling the housing is simultaneously assigned the function of keeping the outside of the drill rod adequately cool.

During the use of the apparatus according to the invention, the danger exists that rock particles ascending from the borehole bottom will soil the expansion lens disposed in the exit area of the laser beam. To prevent this, it is further provided that cleaning nozzles, which extend parallel to the underside of the housing bottom and are aligned with the expansion lens covering the transmission aperture for the laser beam, are disposed in the housing bottom for the partial stream serving as cleaning-gas stream.

In order to supply the laser-guide tube beginning at the housing of the laser-drilling head adequately and over the entire length with a clean protective-gas stream, it is further provided that the transmission duct for the laser beam is equipped within the housing of the laser-drilling head with inlet openings for the partial stream serving as protective-gas stream.

Finally, it is provided that retaining with spacing relative to one another for holding of lens and/or mirror systems that deflect the laser beam are disposed in the interior of the transmission ducts for the laser beam and or of the laser-guide tube, wherein these retaining devices are formed in a way that is permeable to the gas of the protective-gas stream. With such devices, it is possible in case of need to realign and/or to focus the laser beam, in the event that the borehole and accordingly the drill rod deviate from linear shape.

BRIEF DESCRIPTION OF THE DRAWINGS

An exemplary embodiment of the invention will be explained in the following on the basis of the drawings, wherein.

DETAILED DESCRIPTION

Figure 1:
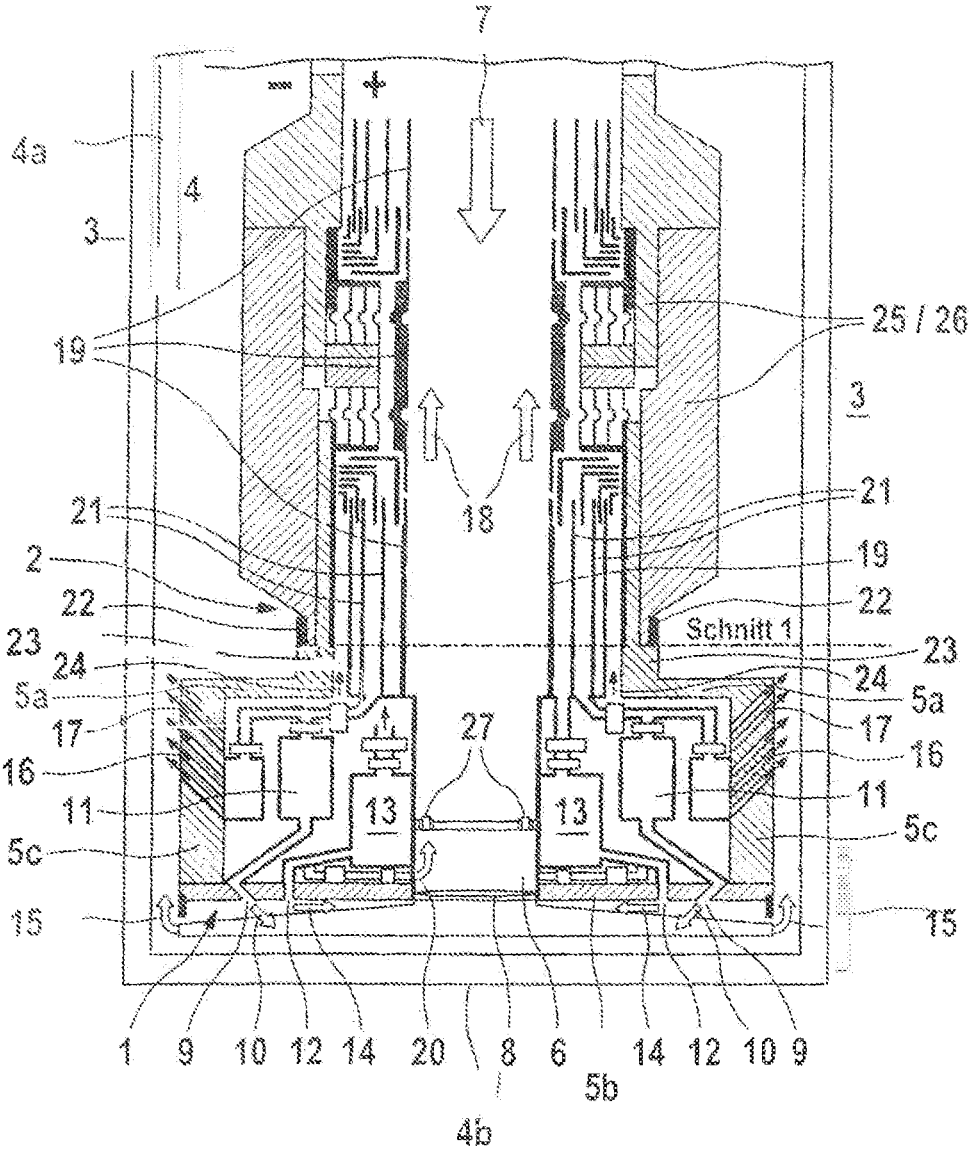
FIG. 1: schematically shows a longitudinal section through the laser-drilling head fastened to the drill rod and situated in its working position above the borehole bottom.
Figure 2:
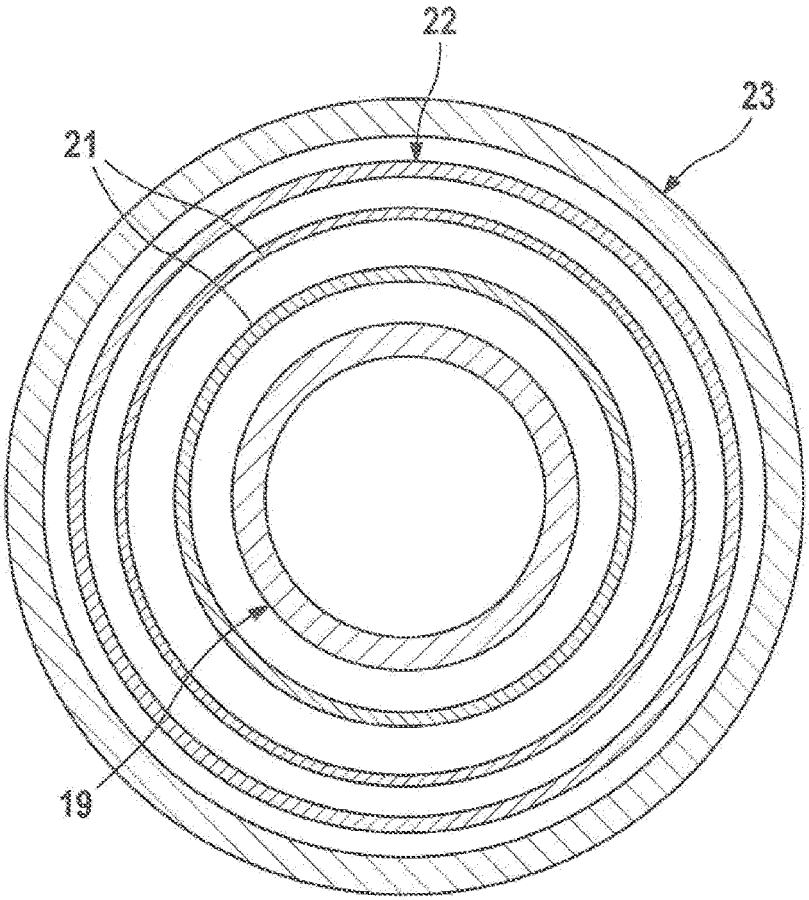
FIG. 2: schematically shows a cross section through the drill rod.

In the drawing, the laser-drilling head is denoted as whole with the reference numeral 1 and the drill rod carrying the laser-drilling head 1 is denoted as whole with the reference numeral 2. The laser-drilling head 1 and the drill rod 2 are situated in a borehole 4, drilled in a rock formation 3, having a borehole wall 4*a* and a borehole bottom 4*b*.

The laser-drilling head 1 held in its working position with small clearance above the borehole bottom 4*b* has a substantially cylindrical housing 5, the housing top 5*a* of which is connected with the drill rod 2.

Furthermore, the housing 5 has, disposed with spacing relative to the borehole bottom 4*b*, a housing bottom 5*b*, which is equipped in the middle with a transmission aperture 6 for a laser beam 7 supplied via the drill rod 2 and propagated through the housing 5. An expander lens 8, which broadens the arriving laser beam 7 so far that the entire borehole bottom 4*b* is bombarded by the laser beam 7, is situated in the transmission aperture 6.

Furthermore, heating-jet nozzles 9, which generate heating-gas streams 10 directed in the direction of the borehole bottom 4*b* and admit heating gas from electrical heating devices 11 disposed in the inner space of the housing 5, are situated in the housing bottom 5*b*.

Moreover, cleaning nozzles 12, which are aligned parallel to the underside of the housing bottom 5*b* in the direction of the expander lens 8 disposed in the middle, are situated in the housing bottom 5*b* and, by a nitrogen-collecting tank 13 situated in the interior of the housing 5, are supplied with clean gaseous nitrogen as cleaning-gas stream 14 for keeping the expander lens 8 clean.

Furthermore, the housing 5 of the laser-drilling head 1 has a housing jacket 5*c*, which leaves open an annular space all around relative to the borehole wall 4*a* for the passage of a conveying-gas stream 15 loaded with the detached rock material and ascending from the borehole bottom 4*b*. This conveying-gas stream 15 has its origin in the peripheral region of the borehole bottom 4*b* being stressed by the heating-gas stream 10 and it transports the rock material detached from the borehole bottom out of the borehole 4.

To support this ascending conveying-gas stream 15, conveying-jet nozzles 16 and 17, which extend at an inclination in the direction of the conveying-gas stream 15 and can admit liquid and/or gaseous nitrogen from the interior of the housing 5, are disposed in the housing jacket 5*c* of the housing 5 of the laser-drilling head 1. To the extent that liquid nitrogen is input via the conveying-jet nozzles 16, it contributes particularly intensively to cooling of rock material contained in the conveying-gas stream 15.

In order to be able to guide the laser beam 7 in the most unattenuated manner possible to the laser-drilling head 1, and in order, moreover, to be able to supply the laser-drilling head 1 with an adequate quantity of nitrogen, a specially constructed drill rod 2 is provided, which will be explained in detail in the following.

This drill rod 2 consists of several tubes disposed concentrically one inside the other, namely:

- an inner laser-guide tube 19, through which a protective-gas stream 18 flows, for the transmission of the laser beam 7; this protective-gas stream 18 consisting of clean nitrogen gas is supplied to the inside of the laser-guide tube 19 above the transmission aperture 6 within the housing 5 of the laser-drilling head 1, and specifically via inlet openings 20, situated in the interior of the housing 5, into the transmission aperture 6;
- concentrically surrounding the laser-guide tube 19 with radial clearance, a double tube 21, through the annular space 21*a* of which liquid nitrogen flows;
- an insulating tube 22, concentrically surrounding the double tube 21 with radial clearance; and an outer protective tube 23, concentrically surrounding the insulating tube 22 with radial clearance.

These annular spaces, surrounding the double tube 21, relative to the laser-guide tube 19 and relative to the insulating tube 22, are evacuated, in order to keep the liquid nitrogen flowing through the annular space of the double tube 21 adequately thermally insulated.

The annular space between the outer protective tube 23 and the insulating tube 22 is connected to a cooling-gas stream 24, which is returning from the housing 5 of the laser-drilling head 1 and which cools the outside of the drill rod 2 adequately.

This outer protective tube 23 consists of steel and ensures good stability and loadability of the entire drill rod 2 contrast, all tubes situated in the interior of the protective tube 23, namely the laser-guide tube 19, the double tube 21 and the insulating tube 22, consist of carbon-fiber-reinforced plastic (CFP).

Furthermore, one or more of the tubes surrounded by the outer protective tube 23 is or are equipped with electrical conductors, not illustrated in detail in the drawing, for transmission of electrical energy and electrical signals in the direction of the laser-drilling head 1.

For simplification of the handling of the drill rod 1, this is subdivided into longitudinal portions, which can be respectively joined with one another at their ends by threaded socket-and-spigot joints 25, 26, wherein the mutually adjoining portions of the laser-guide tube 19 as well as of the annular space of the double tube 21 and of the annular space between the outer protective tube 23 and the insulating tube 22 are joined in aligned and pressure-tight manner with one another in the region of these socket-and-spigot joints 25, 26. Moreover, the mutually adjoining portions of the electrical conductors are connected with one another in electrically conducting manner there. In contrast, the annular spaces present in the individual portions of the drill rod 2 and evacuated for the purpose of insulation of the double tube 21 are respectively closed individually in pressure-tight manner and are not joined with one another.

Finally, retaining devices 27 with spacing relative to one another for holding of the lens or mirror systems that deflect the laser beam 7 are disposed in the interior of the transmission aperture 6 for the laser beam 7 and/or of the laser-guide tube 19, wherein these retaining devices 27 are formed in a way that is permeable to the protective-gas stream 18, i.e. are equipped at the periphery with corresponding through-holes.

Several solenoid valves and volume-flow regulators, which can be activated via the signal conductors contained in the drill rod 2 and which distribute the liquid nitrogen supplied via the double tube 21 to the housing 5 as needed to the conveying-jet nozzles 16, 17 the collecting tank 13 for gaseous nitrogen, the heating devices 11 for the heating-gas stream 10 and the housing inside space, are situated in the housing 5 of the laser-drilling head 1. In the process, the control and regulation take place such that the system remains in thermodynamic equilibrium despite the energy being supplied with the laser beam.

The system illustrated in the drawing works in principle as follows:

A laser beam 7 with a power of 500 KW to 700 KW is injected by a high-power laser generator situated outside the borehole 4 into the laser-guide tube 19 and is guided to the laser-drilling head 1. At the same time, the laser-guide tube 19 admits, from underneath, the protective-gas stream 18 consisting of clean nitrogen gas, so that the laser beam is hardly attenuated on its way to the laser-drilling head 1. In the laser-drilling head 1, the laser beam 7 is then expanded so far with the expander lens 8 that it covers the entire borehole bottom 5*b*.

Simultaneously with the expanded laser beam 7, the borehole bottom 4*b* is stressed with the heating-gas stream 10, which has been brought beforehand by means of the heating device 11 to a temperature that is close to the melting temperature of the rock present at the borehole bottom 4*b* or even exceeds it. Under the effect of the laser beam 7 and the heating-gas stream 10, rock material at the surface of the borehole bottom 4*b* is stripped by melting, evaporation or spalling and forced by the heating-gas stream 10 toward the outer periphery of the borehole bottom 4*b*.

In the process, an upwardly directed conveying-gas stream 15 containing the stripped rock material is formed in this peripheral region and pushes upward through the annular space between the housing jacket 5*c* and the borehole wall 4*a*.

Liquid nitrogen and/or gaseous nitrogen is then blown into this ascending conveying-gas stream by means of the conveying-jet nozzles 16 and 17, whereby the conveying-gas stream 15 is cooled and at the same time intensified. This conveying-gas stream 15 loaded with the rock material is then transported out of the borehole 4 via the annular space between the drill rod 2 and the borehole wall 4*a*.

TABLE-US-00001 LIST OF REFERENCE SYMBOLS

1 Laser-drilling head
2 Drill rod
3 Rock formation
4, 4*a*, 4*b* Borehole, Borehole wall, Borehole bottom
5, 5*a*, 5*b*, 5*c* Housing, Housing top, Housing bottom, Housing jacket
6 Transmission aperture
7 Laser beam
8 Expander lens
9 Heating-gas nozzle
10 Heating-gas stream
11 Heating device
12 Cleaning nozzle
13 Collecting tank for nitrogen gas
14 Cleaning-gas stream
15 Conveying-gas stream
16 Conveying-jet nozzles
17 Conveying-jet nozzles
18 Protective-gas stream
19 Laser-guide tube
20 Inlet openings
21 Double tube
22 Insulating tube
23 Protective tube
24 Cooling-gas stream
25/26 Socket-and-spigot joint
27 Retaining devices

The invention claimed is:

1. A method for drilling a borehole in a rock formation by bombarding the borehole bottom with a laser beam, which is guided to a laser-drilling head situated at the borehole bottom and coupled with a drill rod, wherein nitrogen, supplied to the laser-drilling head via the drill rod, is split into a first partial stream serving as protective gas, which protects the transmitted laser beam from interfering suspended particles, and a second partial stream, serving as a conveying-gas stream, which transports the rock material detached at from the borehole bottom out of the borehole via an annular space remaining between the drill-rod and the borehole wall, wherein the laser beam is guided to the laser-drilling head via, extending over the length of the drill rod, a laser-guide tube, through the open cross section of which the protective-gas stream is flowing, wherein the nitrogen is supplied to the laser-drilling head via the drill rod in liquid state of matter and in the region of the laser-drilling head is changed into a gaseous state of matter, and wherein a third partial stream serving as heating-gas stream is additionally branched off from the supplied nitrogen, and is heated by means of an electric heating device associated with the laser-drilling head and is directed toward the borehole bottom (4*b*) being bombarded by the laser beam.

2. The method according to claim 1, wherein a further partial stream is branched off from the nitrogen and supplied to the laser-drilling head and is injected in liquid state of matter into the conveying-gas stream flowing back from the borehole bottom and loaded with the rock material detached from the borehole bottom, and is a changed therein into the gaseous state of matter, with cooling the conveying-gas stream and the rock material contained in it.

3. The method according to claim 1, wherein a further partial stream) is branched off from the nitrogen supplied to the laser-drilling head and is passed via the drill rod out of the borehole and in the process cools the drill rod from inside.

4. The method according to claim 1, wherein a further partial stream, is branched off from the nitrogen supplied to the laser-drilling head, which keeps clean the laser-beam outlet aperture, turned toward the borehole bottom.

5. An apparatus for performance of the method according to claim 1, wherein the drill rod has:

a laser-guide tube, through which the protective-gas stream flows, for the transmission of the laser beam concentrically surrounding the laser-guide tube with radial clearance, a double tube, through the annular space of which liquid nitrogen flows, an insulating tube, concentrically surrounding the double tube with radial clearance, and an outer protective tube concentrically surrounding the insulating tube with radial clearance, wherein the annular spaces surrounding the double tube in direction to the laser-guide tube and in direction to the insulating tube are evacuated, the annular space between the outer protective tube and the insulating tube is connected to the cooling-gas stream returning from the laser-drilling head and one or more of the tubes surrounded by the outer protective tube is or are equipped with electrical conductors for transmitting of electrical energy and electrical signals to the laser-drilling head.

6. The apparatus according to claim 5, wherein the outer protective tube consists of steel and the tubes disposed in the interior of the protective tube consist of carbon-fiber-reinforced plastic (CFP).

7. The apparatus according to claim 5, wherein the drill rod is subdivided into longitudinal portions, which are respectively joined with one another at their ends by threaded socket-and-spigot joints, wherein, in the region of these socket-and-spigot joints, the mutually adjoining portions of the laser-guide tube as well as of the annular space of the double tube and of the annular space between the outer protective tube and the insulating tube are joined in aligned and pressure-tight manner with one another, the mutually adjoining portions of the electrical conductors are connected with one another in electrically conducting manner, and the successive portions of the evacuated annular spaces surrounding the double tube are closed in pressure-tight manner without joint with one another.

8. The apparatus according to claim 5, wherein the laser-drilling head has a housing, the housing top of which is fastened to the outer protective tube of the drill rod, wherein the housing is further equipped with:

for the laser beam, extending through the housing and connected to the laser-guide tube of the drill rod, a transmission aperture, the outlet aperture of which is covered in light-transmitting relationship in the region of the housing bottom by an expander lens, disposed in the inside space of the housing and connected to the annular space of the double tube of the drill rod, devices for propagation and/or evaporation of the arriving liquid nitrogen as well as for the storage and splitting of gaseous nitrogen to the various provided partial streams, disposed in a housing jacket and extending in inclined manner in the direction of flow of the conveying-gas stream, conveying-jet nozzles for the injection of liquid and/or gaseous nitrogen into the conveying-gas stream, disposed in the housing bottom and directed in the direction of the borehole bottom, heating-gas nozzles for the heating-gas stream, disposed in the housing inside space, an electrical heating device for the heating-gas stream, as well as with solenoid valves and volume-flow regulators for the control and regulation of all nitrogen partial streams.

9. The apparatus according to claim 8, wherein the partial stream serving as cooling-gas stream passes through the housing inner space, wherein the housing inner space is in communication with the annular space between the outer protective tube and the insulating tube of the drill rod.

10. The apparatus according to claim 8, wherein cleaning nozzles, which extend parallel to the underside of the housing bottom and are aligned with an expansion lens covering the transmission aperture for the laser beam, are disposed in the housing bottom for the partial stream serving as cleaning-gas stream.

11. The apparatus according to claim 8, wherein a transmission aperture for the laser beam is equipped within the housing of the laser-drilling head with inlet openings for the partial stream serving as protective-gas stream.

12. The apparatus according to claim 5 wherein retaining devices with spacing relative to one another for holding lens and/or mirror systems that deflect the laser beam are disposed in the interior of a transmission aperture for the laser beam and/or of the laser-guide tube, wherein these retaining devices are formed in a way that is permeable for the gas of the protective-gas stream.

* * * * *